US007325791B2

(12) United States Patent
Koizumi

(10) Patent No.: US 7,325,791 B2
(45) Date of Patent: Feb. 5, 2008

(54) CARBURETOR FOR STRATIFIED SCAVENGING TWO-CYCLE ENGINE

(75) Inventor: Kimio Koizumi, Iwate (JP)

(73) Assignee: Zama Japan Co., Ltd. (JP)

( * ) Notice: Subject to any disclaimer, the term of this patent is extended or adjusted under 35 U.S.C. 154(b) by 0 days.

(21) Appl. No.: 11/226,228

(22) Filed: Sep. 15, 2005

(65) Prior Publication Data

US 2007/0057386 A1 Mar. 15, 2007

(51) Int. Cl.
*F02M 9/08* (2006.01)

(52) U.S. Cl. ..... 261/44.8; 261/45; 261/47; 261/DIG. 1

(58) Field of Classification Search ..... 261/44.6–44.8, 261/45–47, 54–56, 63, DIG. 1
See application file for complete search history.

(56) References Cited

U.S. PATENT DOCUMENTS 6,481,699 B1 * 11/2002 Aihara et al. ..... 261/34.2
6,708,958 B1 * 3/2004 Warfel et al. ..... 261/45
6,755,395 B2 * 6/2004 Nickel ..... 261/23.2
7,104,526 B2 * 9/2006 Mavinahally ..... 261/46
2004/0251564 A1 * 12/2004 Mavinahally ..... 261/23.3
2006/0131763 A1 6/2006 Raffenberg

FOREIGN PATENT DOCUMENTS

JP 09-125966 A 5/1997
JP 09-287521 A 11/1997
JP 10-252565 A * 9/1998

* cited by examiner

*Primary Examiner*—Richard L. Chiesa
(74) *Attorney, Agent, or Firm*—Orrick, Herrington & Sutcliffe LLP

(57) ABSTRACT

A carburetor for a stratified scavenging two-cycle engine, in which a throttle valve and an air valve are formed in a valve element that is a single cylinderical member in which a throttle through-hole and an air through-hole are diametrically formed and which is rotatably fitted in a body, the mixture passage and the air passage being formed piercing through a body, wherein the height of the body is decreased so as to miniaturize the carburetor as a whole, and the mixture passage (6) and the air passage (9) are formed in a single cylindrical common hole (69) in which the mixture passage (6) and the air passage (9) are partitioned by a partition wall (68).

3 Claims, 4 Drawing Sheets

CARBURETOR FOR STRATIFIED SCAVENGING TWO-CYCLE ENGINE

BACKGROUND OF THE INVENTION

1. Field of the Invention

The present invention relates to a carburetor for a stratified scavenging two-cycle engine, which introduces, at first, air in order to exhaust combustion gas with the use of pressure variation in a crank chamber, and thereafter introduces a mixture.

2. Description of the Related Art

Conventionally, there has been known a stratified scavenging two-cycle engine which opens, at first, an exhaust port in order to start exhaustion of combustion chamber after a mixture in a combustion chamber is ignited and exploded so that a piston descends, and then opens an scavenging port so as to introduce a mixture which has been fed in a crank chamber, into the combustion chamber in order to exhaust residual combustion gas, and in which air is at first introduced into the combustion chamber from an air passage so as to exhaust the combustion chamber when the scavenging port is opened, and thereafter the mixture is introduced from the crank chamber into the combustion chamber by way of a scavenging passage.

There has been known, as disclosed in, for example, Japanese Patent Laid-Open No. H09-125966 or Japanese Patent Laid-Open No. H09-287521, the above-mentioned stratified scavenging two-cycle engine in which a throttle valve and an air valve may be simply arranged.

However, the stratified scavenging two-cycle engine as disclosed in the above-mentioned documents, associates the throttle valve with the air valve through the intermediary of a large-sized complicated link mechanism. Japanese Patent Laid-Open No. H10-252565 discloses a stratified scavenging two-cycle engine in which a throttle valve and an air valve are integrally incorporated so that a throttle through-hole and an air through-hole are formed in one cylindrical valve element in a diametrical direction of the latter, and then the valve element is fitted in a single body, the two passages being extended in their parallel parts across the body.

In the stratified scavenging two-cycle engine disclosed in the above-mentioned latter publication, since the throttle valve and the air valve are integrally incorporated with each other, there may be obtained such advantages that they can be fit in a relatively narrow space, and in addition, by appropriately setting diameters of the mixture passage, the throttle through-hole, the air passage and the air through-hole and by appropriately setting phases of the through-holes with respect to the passages, the mixture and the air may be stably controlled at a predetermined flow rate ratio.

However, in the stratified scavenging two-cycle engine as disclosed in the Japanese Patent Laid-Open No. H10-252565, the cylindrical mixture passage and air passage are formed respectively up and down in the cylindrical valve element which is longitudinally fitted in the body so as to be rotatable vertically displaceable.

Accordingly, there have been raised the following problems, that is, since a height which is a sum of values corresponding to the diameters of at least two through-holes, that is, the mixture passage and the air passage and a value corresponding to the thickness of a partition wall partitioning these two through holes is required, miniaturization of the body is difficult, and further, since it is required to form at least two through-holes in each of the valve element and the body, it is difficult to reduce the number of manufacturing steps.

SUMMARY OF THE INVENTION

An object of the present invention is to provide a carburetor for a stratified scavenging two-cycle engine in which a mixture passage having a conventional output control throttle valve and connected to a crank chamber and an air passage having an air valve and connected to a scavenging passage communicating the crank chamber with a combustion chamber are arranged up and down with the mixture passage being underneath the air passage, and the throttle valve and the air valve are formed in a valve element that is a single cylindrical member in which a throttle through-hole and an air through-hole are diametrically formed and which is rotatably fitted in a body, the mixture passage and the air passage being formed piercing through the body, wherein the body has a height which is lower so as to miniaturize the body as a whole, and to reduce the number of manufacturing steps.

The present invention is devised in order to eliminate the above-mentioned problems, and accordingly, the mixture passage and the air passage are formed in a single cylindrical common hole, being isolated from each other by a partition wall in the body in the stratified scavenging two-cycle engine so as to reduce the height of the body in order to miniaturize the body as a whole, and to reduce the number of manufacturing steps.

Further, in the above-mentioned configuration, if the width of the throttle through-hole is larger than the width of the air through-hole, the throttle valve is opened from its closed position prior to the air valve, and accordingly, the throttle valve may be opened prior to the air valve so that the throttle valve may be opened while the air valve is held at its closed position in a low speed range of the engine including an idling speed, thereby it is possible to prevent a mixture ratio from being lean in order to eliminate a risk of unstable rotation of engine, and to maintain a fast idle opening degree by slightly opening the throttle valve in order to increase the quantity of the air mixture during a start of the engine. In addition, during abrupt acceleration of the engine, the opening operation of the air valve lags by a moment in comparison with the throttle valve, and accordingly, the mixture becomes rich, effecting a role of an accelerator pump.

Further, even if the opening area of the air through-hole formed in the valve element is larger than that of the throttle through-hole so that the accelerating performance of an engine such as a stratified scavenging two-cycle engine which uses a mixture set to be relative lean, would have a tendency of deterioration, a rich mixture may be fed.

DESCRIPTION OF THE PREFERRED EMBODIMENTS

Figure 1:
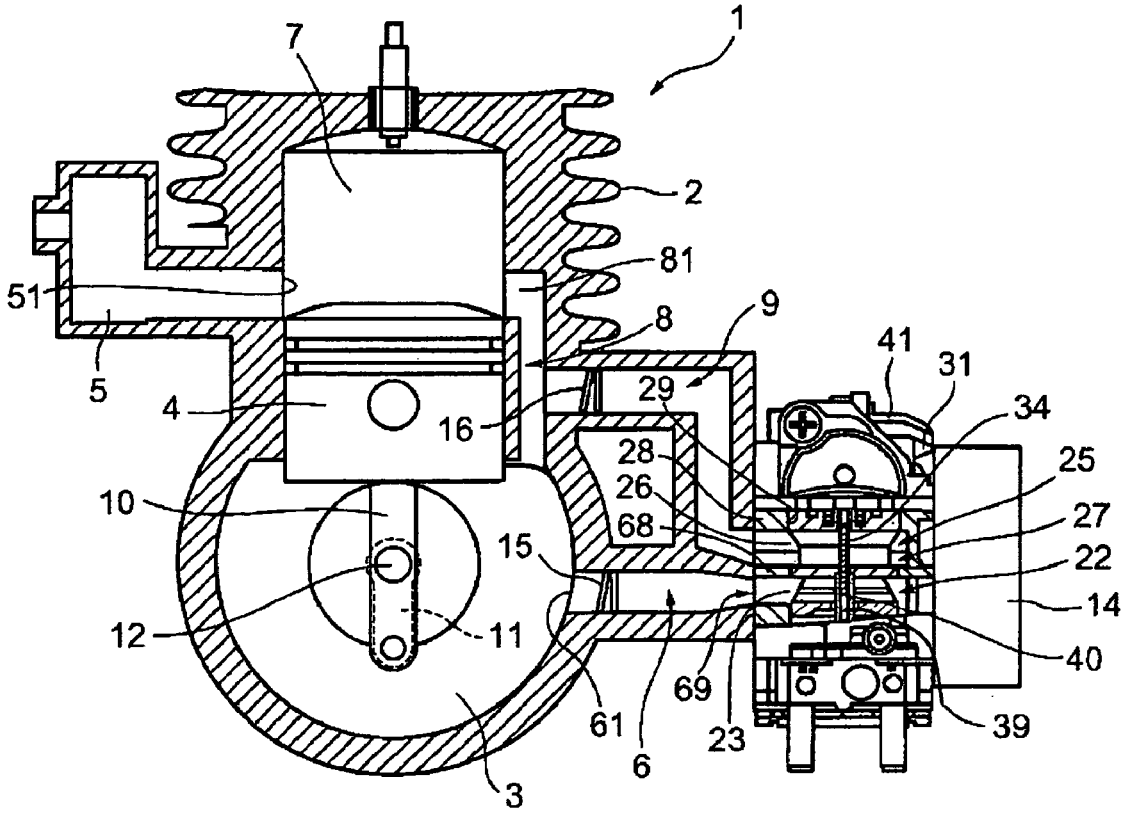
FIG. 1 is a longitudinal sectional view illustrating an embodiment of the present invention.
Figure 2:
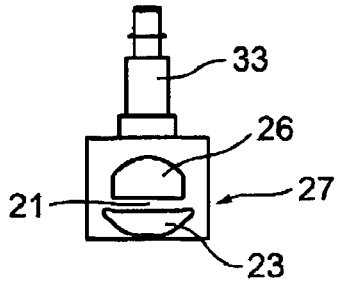
FIG. 2 is a side view illustrating a valve element used in the embodiment shown in FIG. 1.

Referring to FIGS. 1 to 2 which show an example of a best mode of the present invention in the form of a preferred embodiment, an engine 1 comprises a cylinder 2, a crank chamber 3 and a piston 4, an exhaust port 51 as an inlet of an exhaust passage 5 being opened to the cylinder 2 while a suction port 61 serving as an outlet of a mixture passage 6 is opened to the crank chamber 3, and a scavenging passage 9 being connected to the crank chamber 3 so as to communicate the crank chamber 3 with a combustion chamber in the cylinder 2 in a zone above the piston 4.

Further, when the piston 4 ascends from the bottom dead center, the volume of the crank chamber 3 is increased while the piston 4 closes the exhaust port 51 and a scavenging port 81, the pressures in the crank chamber 3 and the scavenging passage 8 are decreased so that a mixture is sucked into the crank chamber 3 through the mixture passage 6 while scavenging air is sucked into the scavenging passage 8 and then into the crank chamber 3 from the air passage 9.

When the piston comes near to the top dead center, the mixture which has been introduced in the combustion chamber 7 during the previous stroke, is ignited and exploded, and accordingly, the piston 4 starts descent so that the pressure in the crank chamber 3 starts increasing. Meanwhile, the exhaust port 51 and the scavenging port 81 are opened so as to start the discharge of the combustion gas from the combustion chamber 7 into the exhaust passage 5 while air jetted from the scavenging passage 8 into the combustion chamber 7 by the pressure in the crank chamber 3 so as to discharge residual combustion gas. Following the scavenging air, a mixture is fed from the crank chamber 3 into the combustion chamber 7 by way of the scavenging passage 8 before the piston 4 comes to the bottom dead center.

With the repetitions of the above-mentioned operation, a crank shaft 12 which is coupled to the piston 4 that carries out rectilinear reciprocating motion, through the intermediary of a connecting rod 10 and a crank arm 11, may be rotated as has been conventionally known.

The mixture passage 6 and the air passage 9 are arranged up and down, for example, with the mixture passage 6 being underneath the air passage 9, in a cylindrical single common hole 69, and are partitioned from each other by a partition wall 68, being opened at their one end openings to a single air cleaner 14, and being incorporated respectively therein with check valves 15, 16 for preventing counter-flowing, in the vicinity of the connection thereof to the scavenging passage 8.

The throttle valve 22 provided in the mixture passage 6, for controlling an output power and the air valve 25 provided in the air passage 9 for controlling a flow rate of scavenging air, are integrally formed as a single cylindrical valve element 27 having a throttle through-hole 23 and an air through-hole 26 which are diametrically formed across the valve element 27, and the valve element 27 is then fitted in a valve hole 29 which is vertically formed in a single body 28 and which is blinded at its bottom end.

Further, in this embodiment, the cylindrical valve body 27, as shown in FIG. 2, is cylindrical as a whole, and the throttle through-hole 23 has a downward facing arched cross-sectional shape, having a width greater than that of the air through-hole 26 which has an upward facing flattened bell shape having vertical sides, and which has an opening area larger than that of the throttle through-hole 23, a partition wall 21 being interposed between the throttle through-hole 23 and the air through-hole 26.

Further, the valve element 27 has a throttle shaft 33 extended upward from the top end thereof, the throttle shaft 33 being extended outward of the valve element 27 and piercing through a cover member 31 which is secured to the body 28, covering the upper opening end of the valve hole 29 as shown in FIG. 1. Further, the valve element 27 has a metering needle 34 which is attached to the valve shaft in the downward direction, and the metering needle 34 is extended across the air through-hole 26 and is then projected into the throttle through-hole 23 from the top of the latter.

Meanwhile, the body 28 is formed at lower end surface on the side remote from the cover member 31 therein with a constant fuel chamber which is partitioned from an atmospheric chamber by a diaphragm, similar to a diaphragm type carburetor which has been conventionally well-known. Thus, fuel flows from the constant fuel chamber into a main nozzle 39 which is projected into the throttle through-hole 23 from the bottom thereof, through a main jet (which is not shown), and is then sucked into the throttle through-hole 23 through a nozzle port 40 having an opening area which is adjusted by the metering needle 34 inserted into the main nozzle 39.

Further, similar to the carburetor of this kind which has been conventionally well-known, an end of the valve shaft 33 which is projected from the cover member 31 is secured thereto with a throttle lever 41. When the throttle lever 41 is turned open through throttle cable wire by the engine operator, the valve element 27 is integrally rotated while twisting a valve opening spring (which is not shown) which is a throttle return spring fixed at its opposite ends to the cover member 31 and the valve element 27, and accordingly, the throttle through-hole 23 overlaps with the mixture passage 6. Thus, the quantity of air is increased in accordance with a degree of the overlapping. Simultaneously, by means of a conventionally well-known cam mechanism (which is not shown) interposed between the cover member 31 and the throttle lever 41, the throttle lever 41 and the valve element 27 are integrally pushed up, and accordingly, a depth of insertion of the metering pin 34 in the fuel nozzle 29 is decreased so as to increase the opening area of the nozzle port 40 in order to increase the flow rate of fuel.

Figure 3:
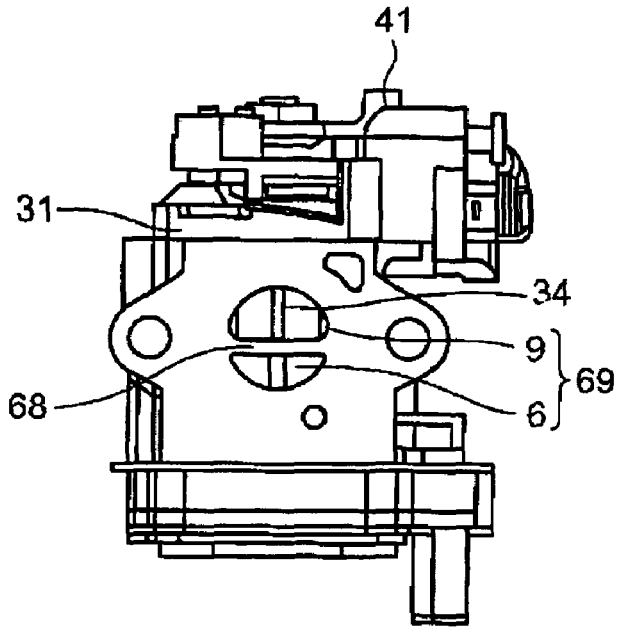
FIG. 3 is a view for explaining an operation when a throttle valve is fully opened in the embodiment shown in FIG. 1.
Figure 4:
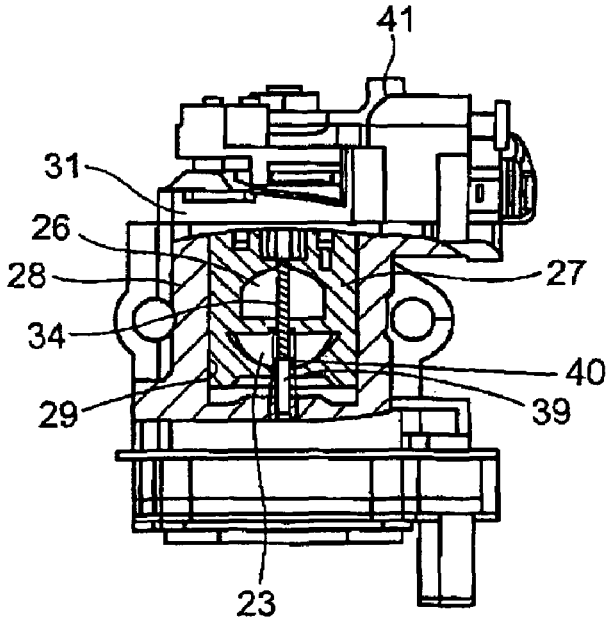
FIG. 4 is a partial sectional view illustrating the valve element shown in FIG. 3.

FIGS. 3 to 8 (which will be referred to as front views) show the carburetor part in this embodiment as viewed from the engine side in order to show relationships among the mixture passage 6 and the air passage 9 formed in the body 28, the common hole 69 partitioned by the partition wall 68, and the throttle through-hole 23 and the air through-hole 26 formed in the valve element 27. FIGS. 3 and 4 are a front view illustrating the carburetor portion, and a partly sectional view illustrating the center part of the valve element 27, respectively, upon fully opening the throttle valve. In this condition, the throttle through-hole 23 and the mixture passage 6 overlap with the each other by such a degree that the throttle valve is fully opened, and further, the air passage 9 and the air through-hole 26 overlap with each other by such a degree that the air-valve 25 is fully opened. It is noted that since the partition wall 21 formed between the throttle through-hole 23 and the air through-hole 26 which are formed in the valve element 27 is made into close contact with the partition wall 68 formed between the mixture passage 6 and the air passage 9 which are formed in the body 28, so as to effect a seal condition, the mixture passage 6 and the air passage 9 are prevented from being communicated with each other even though the valve element is rotated from the idle opening degree to the fully opening degree of the throttle valve.

Figure 5:
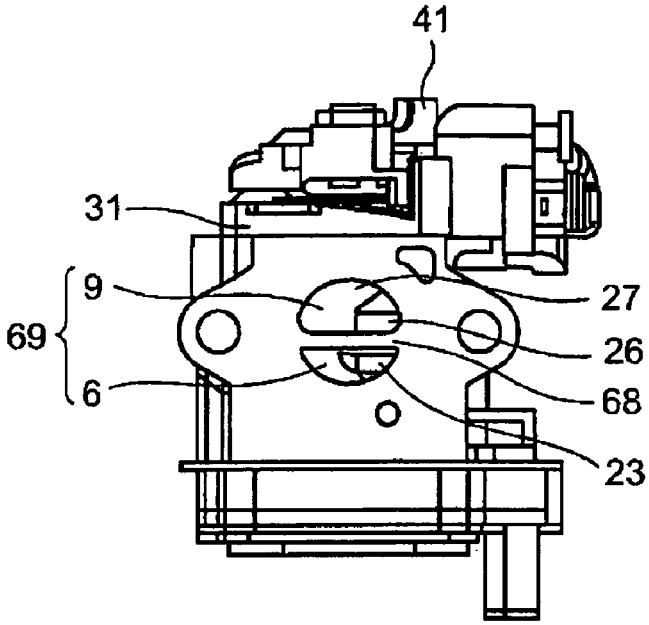
FIG. 5 is a view for explaining an operation when the throttle valve is opened by a half in the embodiment shown in FIG. 1.
Figure 6:
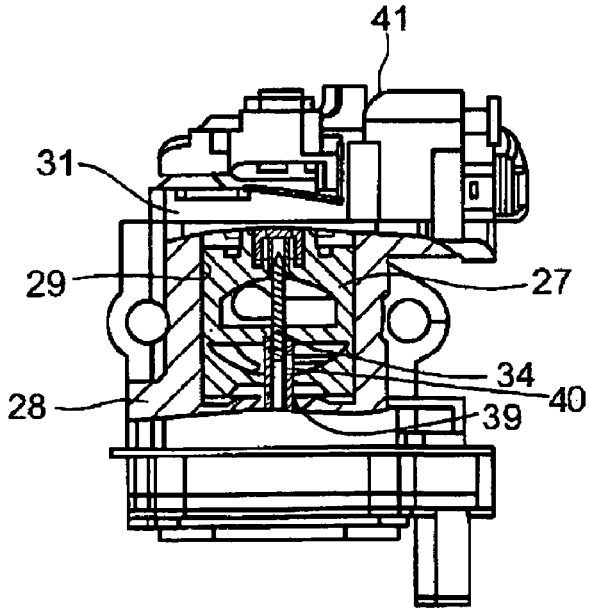
FIG. 6 is a partial sectional view illustrating the valve element of FIG. 5.

Further, FIGS. 5 and 6 are a front view illustrating the carburetor portion and a partly sectional view illustrating the center part of the valve element 27 upon partially opening the throttle lever 41 (a partial opening degree). The throttle through-hole 23 and the mixture passage 6 partly overlap with each other by such a degree that the throttle valve 22 is partly opened, and the air passage 9 and the air through-hole 26 partly overlap with each other by such a degree that the air valve 25 is also partly opened.

At this time, in this embodiment, since the sectional area of the air passage 26 is larger, a rich mixture may be fed into an engine such as a stratified scavenging engine in which a mixture is set to be lean so as to have a tendency of deteriorating an accelerating performance.

Figure 7:
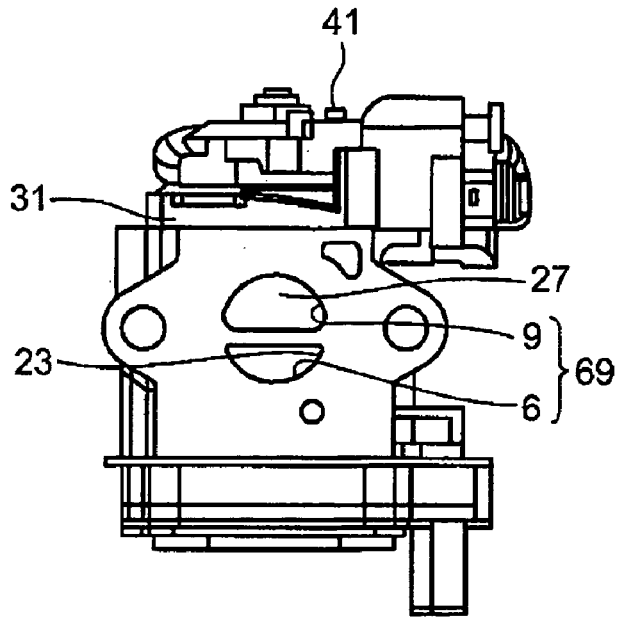
FIG. 7 is a view for explaining an operation when the throttle valve is opened at an idle opening degree in the embodiment shown in FIG. 1.
Figure 8:
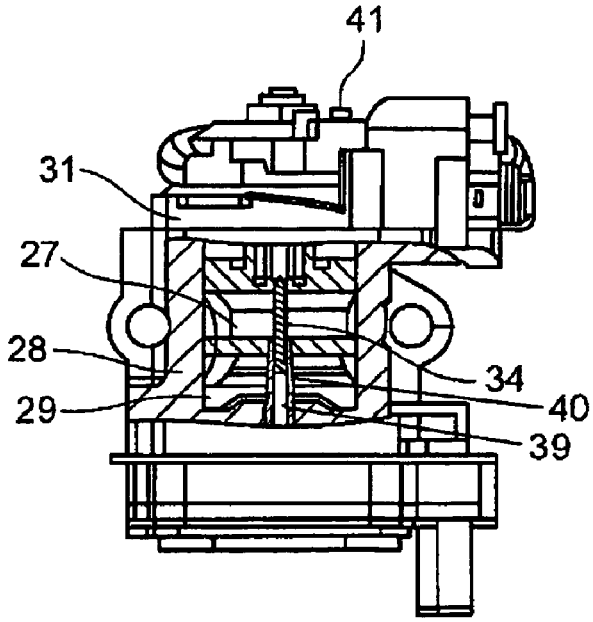
FIG. 8 is a partial sectional view illustrating the valve element shown in FIG. 6.

Further, FIGS. 7 and 8 are front view and a partly sectional view illustrating the center part of the valve element 27. The air passage 9 is closed while the mixture passage 6 is opened, the throttle valve 22 preceding and partly overlapping, and accordingly, the mixture ratio in the combustion chamber does not become lean so as to prevent occurrence of such a risk that the engine speed from being unstable. Further, since it is required to increase the quantity of a mixture during a start of the engine, the throttle valve may be slightly opened in order to maintain the fast idle opening degree. In addition, during abrupt acceleration of the engine, since the opening of the air valve instantly lags behind that of the throttle valve so that the mixture becomes richer in order to effect a role of an acceleration pump.

It is noted that explanation has been made of the embodiment in which the throttle through-hole 23 and the air through-hole 26 formed in the valve element 27 have different shapes. However, they may be formed in semi-cylindrical shapes, respectively, being opposed to each other, the cylindrical valve element being fitted in a single cylindrical common hole 69 in which the mixture passage 6 and the air passage 9 are partitioned by the partition wall 68. With this configuration, the vertically distance thereof can be reduced in comparison with a conventional configuration in which the mixture passage 6 and the air passage 9 are vertically arranged. In particular, the throttle through-hole 23 and the air through-hole may have any other shapes.

What is claimed is:

1. A carburetor for a stratified scavenging two-cycle engine, comprising a mixture passage having a throttle valve for controlling an output power and connected to a crank chamber, an air passage having an air valve for controlling a flow rate of scavenging air, and connected to a scavenging passage communicating the crank chamber with a combustion chamber, wherein the mixture and air passages are arranged up and down with the mixture passage being underneath the air passage, and a single cylindrical valve element comprising a throttle through-hole and an air through-hole are diametrically formed so as to respectively constitute the throttle valve and the air valve, is rotatably fitted in a single body, the mixture passage and the air passages being extended piercing through the body, wherein the mixture passage and the air passage are formed in a single cylindrical common hole in which the mixture passage and the air passage are partitioned from each other by a partition wall in the body, and wherein the throttle through hole is adapted to open to the mixture passage prior to the air through hole opening to the air passage as the valve element is rotated.

2. A carburetor for a stratified scavenging two-cycle engine as set forth in claim 1, wherein the throttle through-hole formed in the valve element has a width which is larger than that of the air through-hole.

3. A carburetor for a stratified scavenging two-cycle engine as set forth in claim 1, wherein the air through-hole formed in the valve element has an opening area which is larger than that of the throttle through-hole.

* * * * *